United States Patent [19]

Rio et al.

[11] 4,397,263

[45] Aug. 9, 1983

[54] DEVICE FOR EFFECTING PROTECTIVE TREATMENTS ON MANUFACTURE IN CONCRETE IN OPERATION AS WELL AS IN PREFABRICATION

[75] Inventors: Arturo Rio; Gennaro Guala; Stefano Biagini, all of Colleferro, Italy

[73] Assignee: Italcementi-Fabriche Riunite Cemento S.p.A., Bergamo, Italy

[21] Appl. No.: 270,890

[22] Filed: Jun. 5, 1981

[30] Foreign Application Priority Data

Oct. 14, 1980 [IT] Italy ..... 49897 A/80

[51] Int. Cl.[3] ..... B05C 5/00

[52] U.S. Cl. ..... 118/643; 118/64; 118/66; 118/415; 404/95

[58] Field of Search ..... 118/64, 58, 47, 305, 118/641, 642, 643, 415, 410, 66; 427/138; 404/77, 95, 79

[56] References Cited

U.S. PATENT DOCUMENTS 3,826,680 7/1974 Rio et al. .

4,109,033 8/1978 Blankenhorn et al. ..... 404/79 X 4,175,885 11/1979 Jeppson ..... 404/95

*Primary Examiner*—John P. McIntosh

*Assistant Examiner*—Mary Beth Calligaris

*Attorney, Agent, or Firm*—Brumbaugh, Graves, Donohue & Raymond

[57] ABSTRACT

Device for effecting protective treatments on manufactures in concrete constituted of the combination in a single apparatus of a panel for the heating of the surface to be treated provided with means for establishing on the surface itself a constant flow of hot air with the possibility to regulate the temperature, and of an assembly being apt to impregnate with a catalyzed monomer the surface of the already heat-treated concrete and to polymerize with hot water the catalyzed monomer once it has been absorbed by the manufacture itself.

3 Claims, 3 Drawing Figures

DEVICE FOR EFFECTING PROTECTIVE TREATMENTS ON MANUFACTURE IN CONCRETE IN OPERATION AS WELL AS IN PREFABRICATION

The present invention has as subject matter a device for the treatment of concrete, with the purpose to realize its impregnation with an organic monomer subsequently polymerized in situ.

The purpose of the invention is that to resolve the known problem of protection and impermeabilization of concrete, on use, when it is exposed to conditions being particularly severe in operation, either by the progressive deterioration of its features of mechanical resistance due to frost or owing to damages being caused by the penetration of attacking substances.

One illustrative example, among the many, can be the case of road wear surfaces in reinforced concrete being located in particularly cold zones, which, because of their extremely low temperature as well as because of the frequent use of antifrost salts in winter, suffer a hasty and extremely quick deterioration and present the phenomenon of a strong salty corrosion of the iron bars of their reinforcement.

As a further example, it may be necessary to impermeabilize and protect the facing of dams and conducts already in operation.

It is known that some attempts have already been made in the U.S.A. for setting up a technology for the treatment of concrete on use, but the resulting techniques, which are herebelow outlined present some serious inconveniences in working which inhibit their use on a large scale in economical terms.

The phases of the process set up in the U.S.A. are the following:

(1) Drying of the concrete manufacture to be treated by an apparatus constituted of a heat isolating cover in which a flow of hot air produced by external heat generating apparatus is put in and distributed through metal sheet conducts having suitable openings.

(2) Disassembly and removal of the whole above described apparatus.

(3) Impregnation of the concrete having been dried before through the distribution on its surface of a slightly dry sand layer which is suitably saturated with a catalyzed monomer.

For avoiding the evaporation of the monomer, there is spread on the surface of the sand a polyethilene sheet which is raised more times for allowing the necessary addition of the monomer, in the points where the sand has dried owing to the absorption of the monomer itself by the concrete.

(4) Polymerization of the monomer absorbed by the concrete through a new positioning of the apparatus already used for drying the concrete on the area covered with the sand layer. The flow of hot air, thus put into touch with the sand which still contains a residual of monomer, provokes the evaporation and the polymerization in the sand of the monomer, and only afterwards it serves for polymerizing the monomer penetrated into the concrete.

Said technology however presents some inconveniences which are listed herebelow.

(1) Necessity to work only on days when the weather is fine, if one does not cover the whole area with a movable shed.

(2) Lack of protection against water dripping on the surface of the manufacture to be treated, also in case of complete coverage of the working area, especially if the surface—as in most cases—has a slope.

(3) Difficulty in the operations of spreading thinly and final recovery of the sand employed in the process.

(4) Necessity of a demolition work of the impregnated sand crust where it completely sticks to the treated concrete surface owing to the polymerization of the excess of monomer contained therein.

(5) Great waste of monomer (about 50%) owing to the impossibility of evaluating exactly the quantity of monomer necessary to ensure that the concrete be wholly impregnated and the sand remains nearly without monomer at the end of the process.

(6) Heavy inconveniences for workers in this field due to the vapours of monomer developed by the high surface exposed to the air of the sand layer utilized in the impregnation phase, because said layer must be repeatedly sprinkled with fresh monomer, in order to maintain the sand saturated.

Analogous proceedings do not present less inconveniences.

SUMMARY OF THE INVENTION

In order to resolve those problems, the present invention proposes to refer to an application of the technology of impregnation of prefabricated concrete manufactures with polymerizable resins as described in Italian patent 932.873 filed on Jan. 27, 1971 and granted on Nov. 15, 1972 to the same Applicants.

The present invention renders, in fact, possible to extend the application of such technology also to concrete on use.

As it is already known, the technology of impregnation of concrete manufactures with polymerizable resins is constituted of the following treatment phases:

(I) Heat treatment in a furnace of the manufacture being prepared for impregnation, with the obtainment, in function of the thickness of the grade of desired dehydration.

(II) Impregnation by immersion of the heat treated manufacture into a polymerizable monomer adding a suitable catalyser (the impregnation can be eventually accelerated by the use of nitrogen pressure).

(III) Immersion of the impregnated manufacture with the polymerizable monomer into a water bath maintained at a temperature suitable for the heat catalyzing polymerization of the monomer itself (about 80° C.).

The water has, in this way, the double function of heat source for the polymerization of the resin and of a means for preventing the escape of the monomer from the pores of the impregnated manufacture.

According to the invention, a device is foreseen constituted of the combination is a single apparatus of a panel for the heating of the surface to be treated by using an adequate circulation of a diathermic liquid at a high temperature with the possibility to regulate the supplied power and of an equipment which allows the impregnation of the surface of the already thermically treated concrete with a monomer, and subsequently the polymerization with hot water thermocatalytically of the monomer once it has been absorbed by the same manufacture and to complete the proceeding of polymerization with a more prolonged treatment eventually at a higher temperature.

BRIEF DESCRIPTION OF THE DRAWINGS

The invention will now be described with reference to the enclosed drawings which represent as an illustrative and not limitative title a preferred embodiment of the invention itself.

DESCRIPTION OF EXEMPLARY EMBODIMENT

Figure 1:
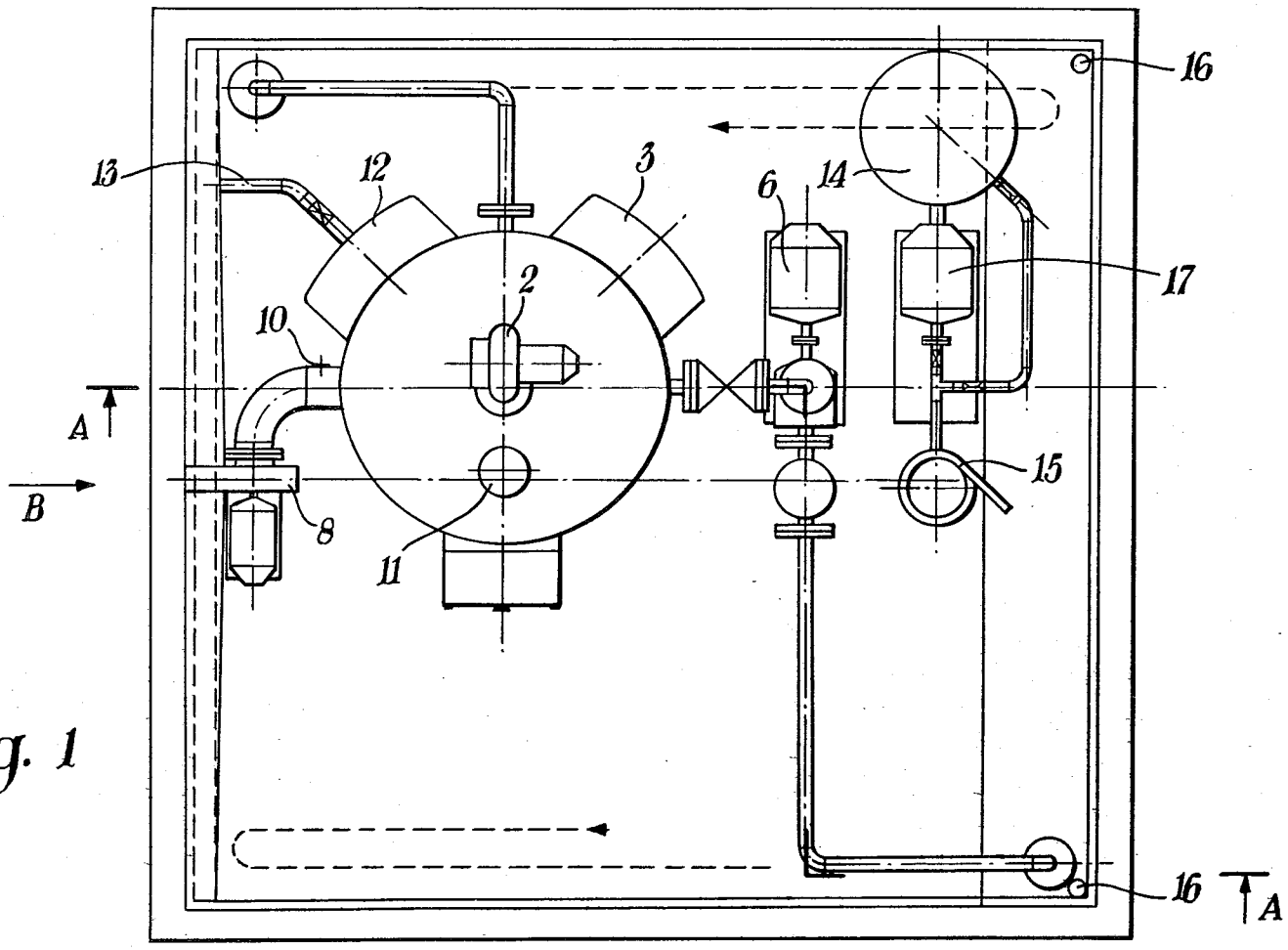
FIG. 1 is a schematical, plan view.
Figure 2:
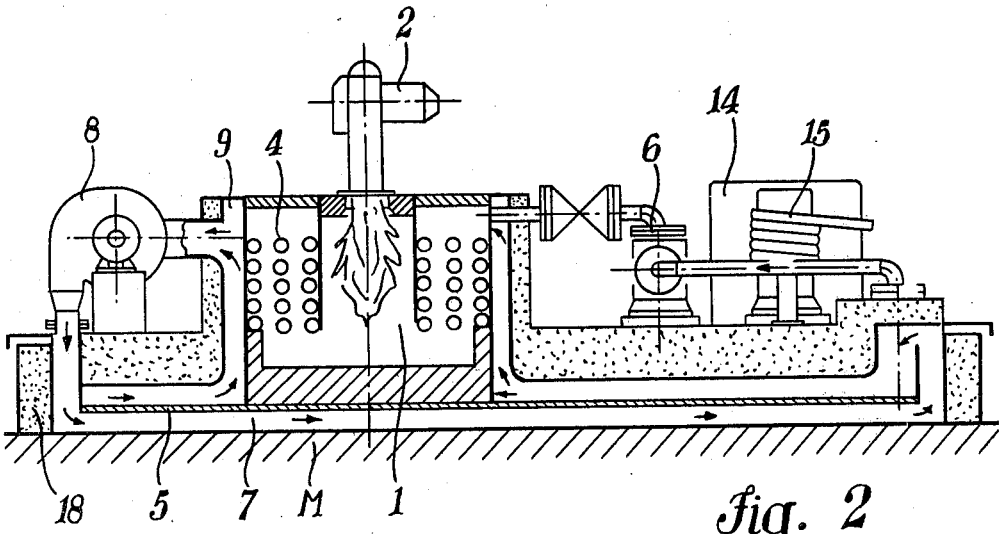
FIG. 2 is a sectional view according to plane A—A of FIG. 1.
Figure 3:
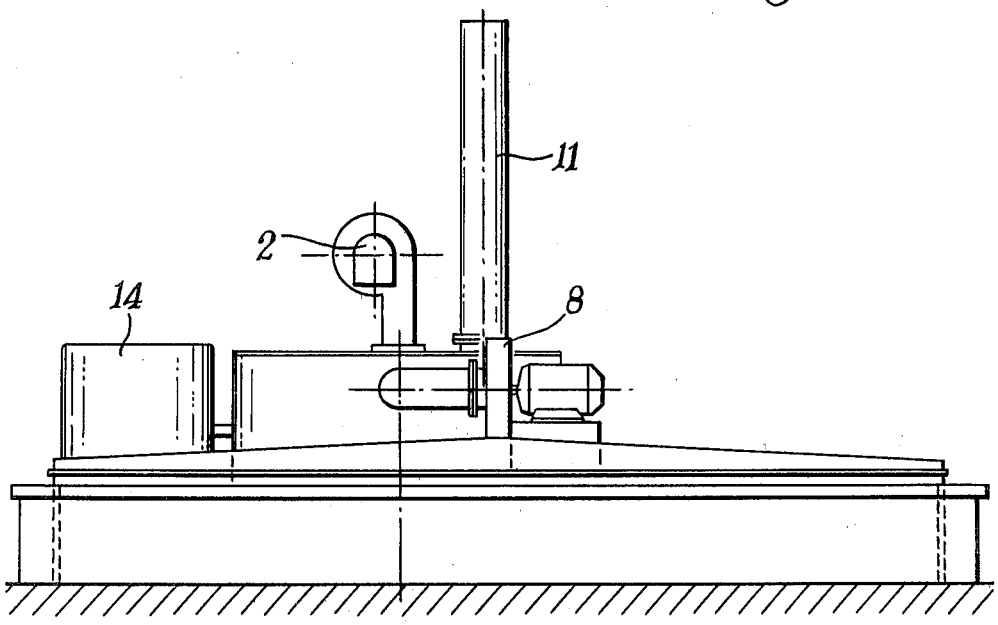
FIG. 3 is an elevational view, observed according to direction B of FIG. 1.

With reference to the drawings, and in particular FIG. 2 numeral 1 indicates a heat generator including a burner 2 fed with liquid fuel from the tank 3 which, through the coil 4 in which diathermic oil is circulating, heats the radiant plate 5. The diathermic oil is kept in circulation through the pump 6. In the hollow space 7 between the manufacture M and the plate 5 a flow of hot air is maintained which is generated by the blower 8, which recycles the air of the jacket 9 which surrounds the thermic generator 1 and sends it into said hollow space, in the direction as indicated by the arrows of FIG. 2. For sucking fresh air from the ambient atmosphere, a valve 10 (FIG. 1) is provided. The products of the combustion of the burner 2 are conveyed towards the atmosphere through the chimney 11. In a position near to the thermic generator 1 a water tank 12 is situated which is heated by the generator itself and which serves for the polymerization. From the tank 12 a tube 13 is provided which has the purpose of releasing upon control the hot water into the hollow space 7.

The monomer is contained in the tank 14 and can be conveyed into the hollow space 7 through the flexible hose 15 which is inserted into one of the holes 16. For recovering the monomer, a pump 17 is connected with the hose 15 and the tank 14.

The whole apparatus now described is surrounded by the frame 18 which serves each time to delimit and protect, on the manufacture M, the zone under treatment.

The operative phases effected by the above apparatus are the following:

A-Concrete drying phase

The apparatus is put on the manufacture M and through suitable sealing of the peripheral containment 18 of the frame it is isolated from the external environment.

Subsequently, through the starting of the burner 2 and the thermal exchange in the heat generator 1, the diathermic oil, kept in circulation by the pump 6, transfers the generated heat to the heating plate 5, which maintained by the structure itself of the apparatus at a suitable distance from the surface of the manufacture, provides for the dehydration of the concrete to be treated. Said dehydration process is furthermore favoured by the circulation of hot air kept in motion by the blower 8.

The dehydration temperature can be adjusted by varying the temperature of the diathermic oil.

Once the dehydration treatment is effected, the burner 2 is extinguished and the pump 6 stops, so that in a certain number of hours, according to the maximum temperature reached, the manufacture is cooled to a surface temperature of about 30° C., which allows the beginning of the second phase of the treatment.

The cooling phase can be accelerated by the ventilation system, by which it is possible to introduce—through the valve 10—the necessary quantity of cold air taken from the atmosphere.

B-Impregnation phase

The monomer containing the catalyzer coming from the tank 14 is put into the hollow space 7 by the flexible hose 15 which is introduced into one of the holes 16. In case of a manufacture of a high slope, it is foreseen that the radiant plate 5 is provided with a raised edge which impedes the overflowing of the monomer into the air circulation conducts. This permits the reduction of the volume of the employed monomer to the pure volume of the hollow face 7. The weight of the apparatus is such as to overcome the thrust of the liquid contained in the hollow face 7. At the end of the time period necessary for the impregnation, the monomer is recovered by the pump 17.

C-Phase of polymerization with water

The water necessary for the polymerization having the possibility to be pre-heated, is taken from the tank 12 and is caused to flow into the hollow space 7 through the tube 13. In the hollow space the water is brought to and maintained at the temperature of 80°-90° C. by the heat supplied by the radiant plate 5.

Once the period of time fixed for a sufficient polymerization of the monomer absorber by the concrete has elapsed, the temperature of the diathermic oil can be further increased by the regulation of the burner so as to make the water in contact with the surface of the concrete itself completely evaporate.

The heating at a high temperature can be further prolonged for a more complete polymerization in case the monomers employed require a higher treatment temperature.

The application tests of a thus combined apparatus to manufactures already in use and the analyses effected subsequently on numerous samples taken therefrom, indicate that with such a technology it is possible to obtain easily a complete impermeabilization and a nearly absolute protection of the manufactures themselves, against subsequent attacks by water, frost and attacking salt solutions.

In fact, adopting a heating cycle suitable for the type and quality of the manufacture to be treated and using a monomer or a mixture of monomers chosen either for their low viscosity or for the particular type of polymer or copolymer which can be obtained therefrom, at the end of the treatment one can obtain a complete impermeabilization and protection of the concrete through the intimate impregnation for a desired thickness of its superficial layer of a polymer, reducing strongly its porosity and stress its resistance to external agents.

Preferably, as monomers one uses methyl-methacrylate, styrene and a mixture of these with polyester resins.

The apparatus according to the invention can also be advantageously employed in the treatment of prefabricated manufactures, particularly in heavy prefabrication.

The present invention has been described in one of its preferred embodiments but it is clear that constructive variations can be in practice made thereto by a person skilled in the art, without departing from the scope of protection of the present invention.

What is claimed is:

1. A device for protecting and rendering impermeable a concrete manufacture on use, comprising (a) heating means for dehydrating a surface layer of said manufacture whereby pores are formed therein, said heating means comprising a radiant plate arranged at a space from said concrete manufacture, a combustion chamber, a spiral tube coil containing diathermic oil arranged within said combustion chamber above said radiant plate, a circulating pump for circulating said diathermic oil within said spiral tube coil, a burner means for selectively heating to a desired temperature said spiral tube coil and thereby said radiant plate and a blower means for circulating a flow of hot air within said space between said radiant plate and said concrete manufacture;

(b) means for impregnating said surface layer with a liquid monomer whereby said monomer penetrates said pores;

(c) means for supplying water to said surface layer impregnated with said liquid monomer for polymerizing said monomer under said water which is heated by said heating means to a temperature range of substantially 80° C. to 90° C.; and (d) a peripheral frame means abutting said concrete manufacture and isolating said space from the ambient atmosphere.

2. A device according to claim 1, wherein said impregnating means comprises a tank containing said liquid monomer, a flexible hose supplying said monomer into said space between said radiant plate and said concrete manufacture, and a recovery pump for recovering excess monomer following said impregnation.

3. A device according to claim 1, wherein said polymerization means comprises a water tank adjacent to said heating means and a tube for supplying water preheated by said heating means to said space between said radiant plate and said concrete manufacture for covering said surface layer impregnated with said monomer.

* * * * *